United States Patent [19]

Wulf, deceased

[11] Patent Number: 5,012,552

[45] Date of Patent: May 7, 1991

[54] BLIND AND CARRIER FOR VERTICAL SLATS AND/OR CURTAINS

[75] Inventor: Hubert J. Wulf, deceased, late of Aschendorf, Fed. Rep. of Germany, by Maria A. Wulf, nee Bothorn, heiress

[73] Assignee: Riloga-Werk Julius Schmidt GmbH & Co. KG., Remscheid, Fed. Rep. of Germany

[21] Appl. No.: 444,545

[22] Filed: Dec. 1, 1989

[30] Foreign Application Priority Data

Jan. 10, 1989 [DE] Fed. Rep. of Germany ..... 3900465

[51] Int. Cl.[5] ..... A47H 13/00

[52] U.S. Cl. ..... 16/87.4 R; 16/87.2; 160/168.1; 160/900

[58] Field of Search ..... 16/87.2, 87.4, 93 D, 16/93 R, 95 D, 96 D; 160/168.1, 178.1, 900

[56] References Cited

U.S. PATENT DOCUMENTS 3,844,330 10/1974 Hyman ..... 160/168.1
3,851,699 12/1974 Shapiro ..... 160/168.1
4,227,282 10/1980 Ford ..... 16/93 R
4,262,728 4/1981 Debs ..... 160/168.1
4,356,855 11/1982 Holzer ..... 160/900
4,628,981 12/1986 Ciriaci et al. ..... 160/168.1

*Primary Examiner*—Richard K. Seidel
*Assistant Examiner*—Patty E. Hong
*Attorney, Agent, or Firm*—Peter K. Kontler

[57] ABSTRACT

A blind with vertical slats has a horizontal rail for a row of trolleys which carry connectors for the upper end portions of slats and further constitute or form part of holders for the upper portion of a curtain. This ensures that the gaps between neighboring slats are bridged by the curtain when the slats are oriented in such a way that they permit light to pass between them. In addition, the curtain can be used to prevent penetration of any light, or excessive amounts of light, into or from a room when the slats are detached from their trolleys for the purpose of inspection, cleaning or replacement. The marginal portion of the curtain can carry or constitute a strip of velvety material which can strongly adhere to the barbs of one or more strips of "VELCRO" (trademark) or a like material which reliably secures the curtain to the connectors for the upper end portions of the slats.

18 Claims, 3 Drawing Sheets

FIG. 3
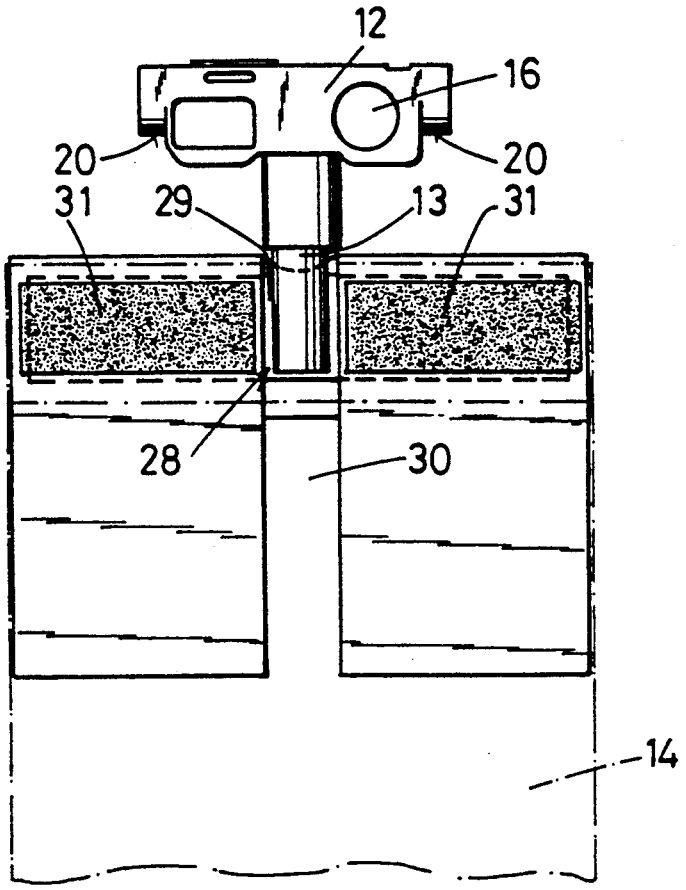
FIG. 4
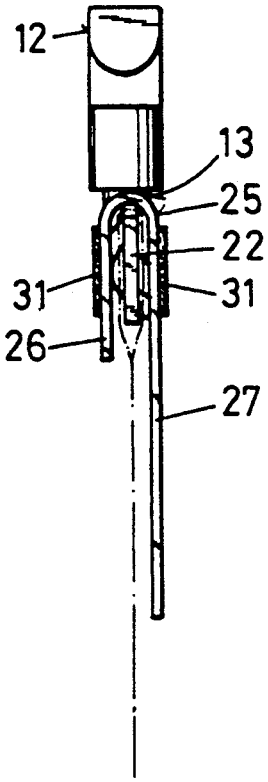
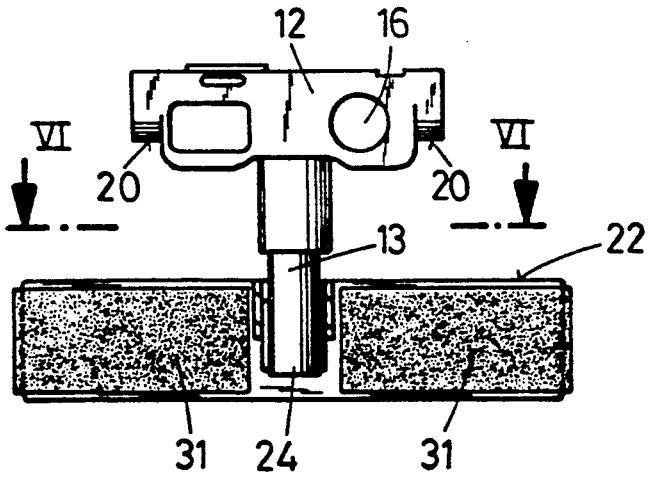
FIG. 5
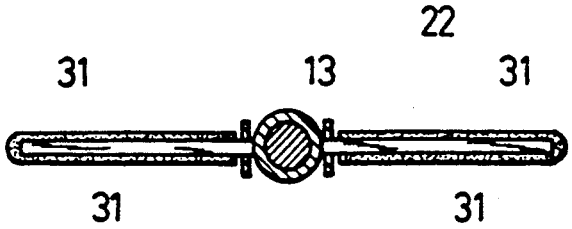
FIG. 6

BLIND AND CARRIER FOR VERTICAL SLATS AND/OR CURTAINS

BACKGROUND OF THE INVENTION

The invention relates to improvements in blinds, and more particularly to improvements in blinds with vertical slats.

A blind with vertical slats normally comprises a support in the form of an elongated rail which defines an internal track for a row of carriers in the form of trolleys which are movable along the track. The trolleys support connecting elements which carry the upper end portions of vertical slats, and the trolleys can be moved longitudinally of the rail by means of a cord. A shaft or a like motion-transmitting part is provided to turn the connecting elements about vertical axes in order to change the orientation of the slats, namely the extent to which neighboring slats overlap or the extent to which neighboring slats permit light and/or air to pass between them. Neighboring trolleys of the rod are connected to each other by suitable distancing elements.

If a blind of the above outlined character is used to prevent penetration of light into or from a room, for example, to prevent penetration of daylight or other outside light into a room which is to be used for projection of images of film frames or diapositives onto a screen, even the slats are made of an opaque plastic or other material. This can detract from the appearance of the room or from the appearance of the building in which the blind with dark slats is put to use. Moreover, it is necessary to clean the slats from time to time, and any thorough cleaning involves detachment of the slats from the respective trolleys. Therefore, persons walking past a window or door which is equipped with a blind having vertical slats, or persons looking at the door or window from neighboring buildings, have practically unobstructed view of the activities in the room as long as the slats remain detached from their carriers. This is often highly undesirable, for example, if the room is a conference room or an office for conducting confidential discussions and/or for displaying objects which should not be seen by unauthorized persons and/or for divulging (e.g., displaying) information which is to remain confidential.

OBJECTS OF THE INVENTION

An object of the invention is to provide a blind having vertically or substantially vertically extending slats which is constructed and assembled in such a way that it can prevent outsiders from looking into the room wherein the blind is installed, even if the slats are moved to such positions that they establish wide gaps for penetration of light and air between them.

Another object of the invention is to provide a blind having vertical or substantially vertically extending detachable slats which is constructed and assembled in such a way that it can prevent outsiders from looking into a room wherein the blind is installed even if the slats are detached from their carriers.

A further object of the invention is to provide novel and improved means for enhancing the versatility of a blind with vertical or substantially vertical slats.

An additional object of the invention is to enhance the appearance of a blind with vertical or substantially vertical slats.

Still another object of the invention is to provide a method of and means for converting a standard blind into a blind of the above outlined character.

A further object of the invention is to provide a novel and improved blind which exhibits the above outlined features and can be used as a superior substitute for existing conventional blinds.

Another object of the invention is to provide novel and improved means for connecting the upper end portions of vertical or nearly vertical slats to the respective carriers of the above outlined blind.

An additional object of the invention is to provide a novel and improved curtain for use with or in the above outlined blind.

A further object of the invention is to provide a novel and improved curtain-blind combination.

A further object of the invention is to provide a simple and relatively inexpensive blind which can be used with available curtains.

Another object of the invention is to provide a blind wherein the orientation and/or mutual spacing of the slats can be changed with the same facility as in conventional blinds.

An additional object of the invention is to provide a blind which can be equipped with available devices for changing the orientation and/or mutual spacing of vertical or nearly vertical slats.

SUMMARY OF THE INVENTION

The invention is embodied in a blind which comprises an elongated support, a row of carriers provided on the support and serving to support or carry the upper end portions of discrete substantially vertical slats, and curtain holding means provided on the carriers, i.e., the carriers can support a curtain in addition to or in lieu of slats. The support preferably defines at least one elongated substantially horizontal track, and the carriers preferably include trolleys which are movable (e.g., slidable) along the track.

The holding means preferably includes means for connecting the upper end portions of the slats to the respective carriers. The holding means further comprises means for suspending a curtain on the connecting means. The suspending means can include coupling members or adapters and means for securing a portion of a curtain to each coupling member. The securing means can include means for clinging to the respective portions of a curtain, and such means for clinging can include strips of barbs (e.g., "VELCRO" (trademark) strips).

The securing means can be integral with the respective coupling members, and such coupling members can be made of or can contain a plastic material.

Each connecting means can include a substantially plate-like member, and the coupling members are or can be substantially U-shaped and then include pairs of legs which flank the respective plate-like members. The carriers include downwardly extending portions (e.g., substantially vertical shafts) which are attached to the respective plate-like members, and each coupling member has an opening for the aforementioned portion of the respective carrier. The U-shaped coupling members further include webs which are disposed between the respective pairs of legs and overlie the corresponding plate-like members. The openings are provided in the webs, and one leg of each U-shaped coupling member can be provided with an open-ended slot which communicates with the respective opening. If each U-shaped coupling member has a longer leg and a shorter leg, the slot can be provided in the longer leg. The slots serve to facilitate introduction of the aforementioned portions of the carriers into the openings of the associated coupling members.

The coupling members can be omitted if at least one side of each plate-like member is provided with means for clinging to a portion of a curtain.

The improved blind can be used with advantage to carry curtains of the type having portions of velvety material which can be reliably engaged and retained by the aforementioned clinging means of the plate-like members or of the coupling members. For example, the upper portion of a curtain to be separably attached to the improved blind can include or constitute a strip of velvety material, and such strip can include colored indicia.

The trolley-shaped carriers are preferably movable along the track and turnable with reference to the support about substantially vertical axes. Such blind further comprises means for moving the trolleys along the track and means for turning the curtain holding means with reference to the support. The turning means can include a vertical shaft rotatably mounted in each trolley, defining the respective vertical axis, and connected with the upper end portion of the corresponding slat, and a horizontal shaft having means (e.g., teeth or threads) for simultaneously turning the vertical shafts with reference to the respective trolleys.

The novel features which are considered as characteristic of the invention are set forth in particular in the appended claims. The improved blind itself, however, both as to its construction and the mode of assembling and operating the same, together with additional features and advantages thereof, will be best understood upon perusal of the following detailed description of certain presently preferred specific embodiments with reference to the accompanying drawing.

BRIEF DESCRIPTION OF THE DRAWING

FIG. 3 is an enlarged transverse vertical sectional view substantially as seen in the direction of arrows from the line III—III of FIG. 1, with a portion of one of the slats indicated by phantom lines and showing one of the combined curtain holding and slat connecting devices;

FIG. 4 is a left-hand side elevational view of the structure which is shown in FIG. 3;

FIG. 5 is a view similar to that of FIG. 3 but showing a modified combined curtain holding and slat connecting device;

FIG. 6 is a horizontal sectional view substantially as seen in the direction of arrows from the line VI—VI of FIG. 5;

DESCRIPTION OF PREFERRED EMBODIMENTS

Figure 1:
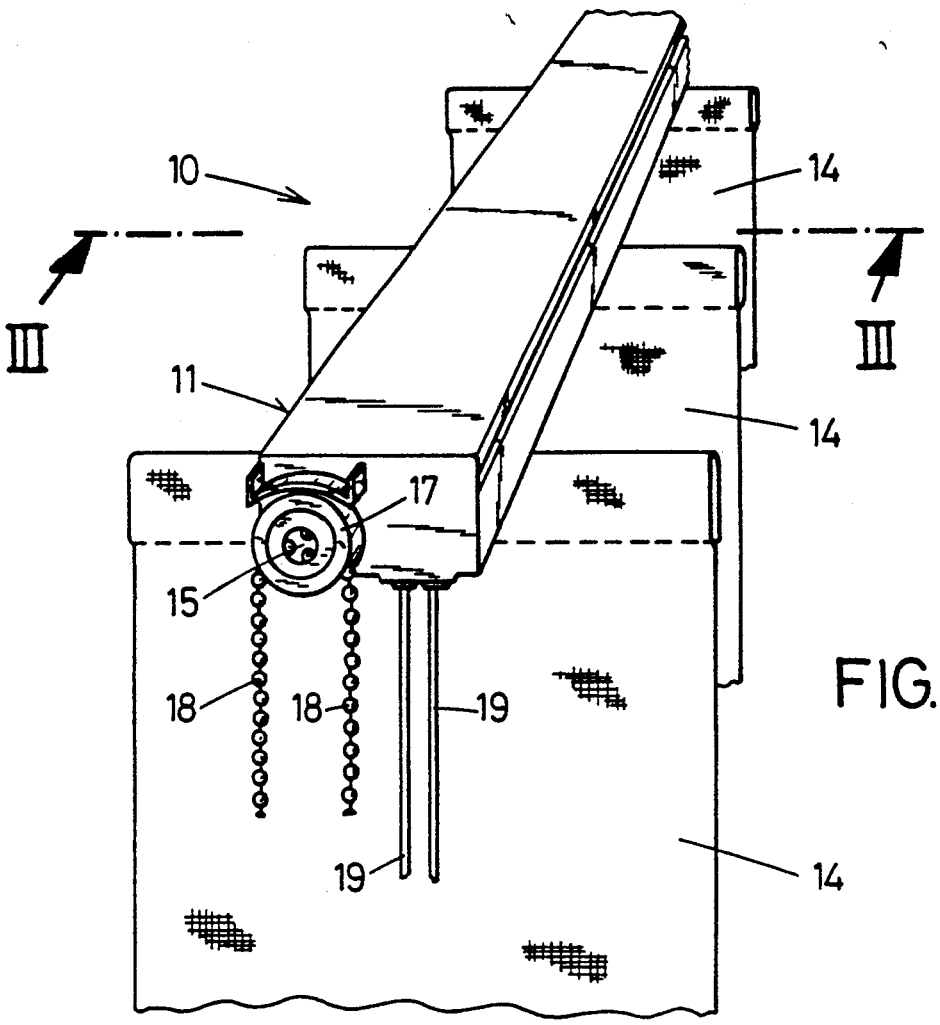
FIG. 1 is a fragmentary perspective view of a blind with vertical slats which embodies one form of the invention.

FIG. 1 shows a portion of a blind 10 which comprises an elongated hollow metallic or plastic support 11 in the form of a rail having two parallel internal tracks for a row of carriers or trolleys 12 (one shown in FIGS. 3 and 4) each of which indirectly supports the upper end portion of a vertical or substantially vertical slat 14. Each slat 14 can consist of or can contain a textile material, a plastic material, a metallic material, wood or any other suitable material. The trolleys 12 are provided with downwardly extending bearing sleeves for vertical stub shafts 13 which are rotatably mounted therein and serve to support plate-like connecting members 22 which, in turn, directly support the upper end portions of the respective slats 14. The means for jointly turning the shafts 13 of all of the trolleys 12 comprises a horizontal shaft 15 which is rotatably mounted in the end portions of the support 11 and extends through apertures 16 in the trolleys to engage the upper end portions of the stub shafts 13 (e.g., by means of threads or teeth) in such a way that rotation of the shaft 15 in a selected direction and to a desired extent entails a turning of the shafts 13 and hence a change of orientation of the slats 14. The means for rotating the shaft 15 includes a sprocket wheel 17 adjacent one end of the support 11 and a chain 18 with spherical links which engages the sprocket wheel 17 and can be manipulated by an operator to move the slats 14 between first and second end positions in one of which the marginal portions of neighboring slats overlap each other and in the other of which the planes of the slats 14 are substantially parallel to each other and extend transversely of the support 11 so that the slats permit a maximum amount of light and air to pass between them. The chain 18 can further move the slats 14 to a practically infinite number of intermediate positions.

Neighboring trolleys 12 are connected to each other by flexible distancing elements (not shown) which enable a cord 19 to move the slats 14 nearer to or away from each other by moving the remotest trolley 12 toward or away from the sprocket wheel 17. The lower end portions of the slats 14 may but need not be connected to each other by short chains or cords which determine the maximum spacing between such lower end portions.

The end portions 20 of each trolley 12 are rounded and constitute simple followers which are slidable along the respective tracks of the support 11 in response to a pull upon the one or the other section of the cord 19.

The heretofore described parts of the blind 10, with the exception of the plate-like connecting members 22, are known and operate in a conventional manner.

Figure 7:
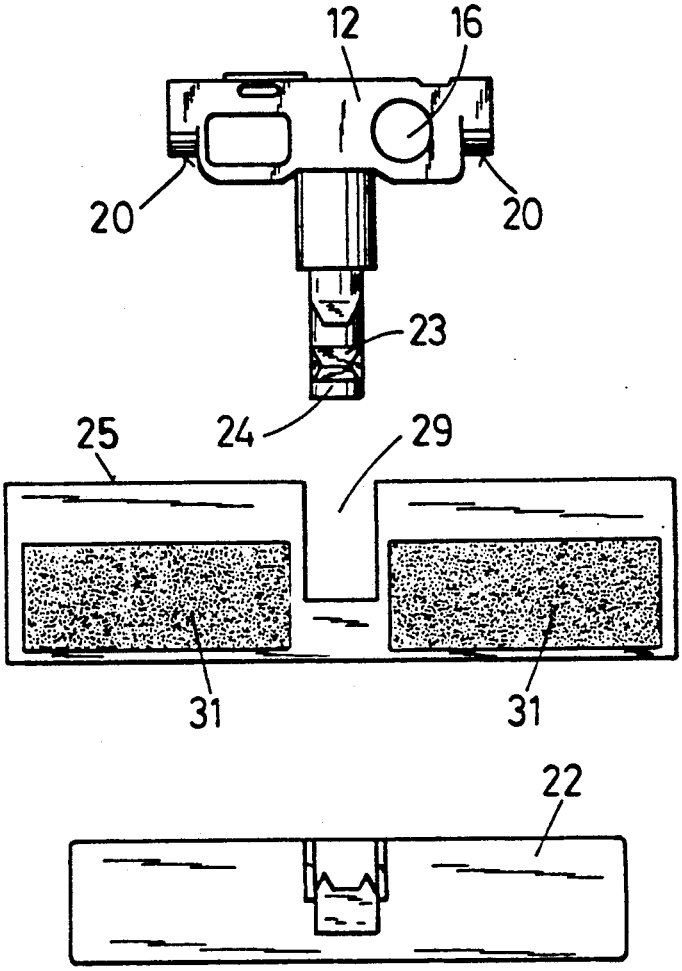
FIG. 7 is an exploded view of a trolley and of a third combined curtain holding and slat connecting device.

FIG. 7 shows that the lower end portion 24 of each stub shaft 13 is provided with a hook-shaped retaining portion 23 for the respective plate-like connecting member. Each connecting member 22 can be affixed to the respective retaining portion 23 by snap action.

Figure 2:
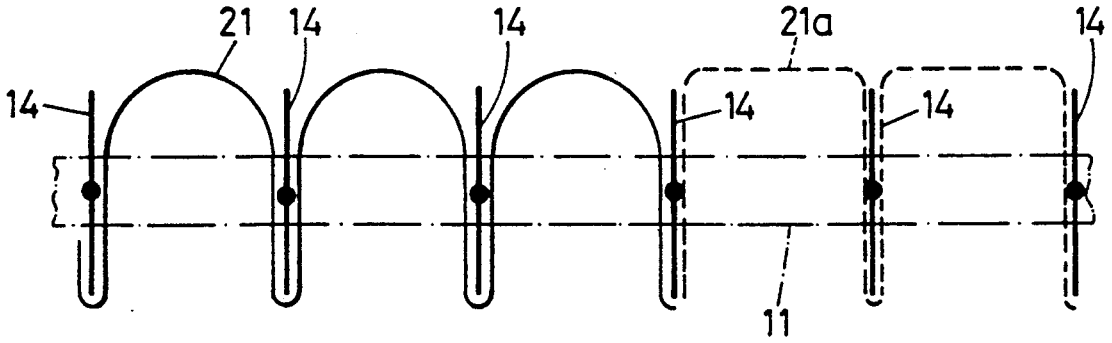
FIG. 2 is a fragmentary schematic plan view of certain portions of the blind and of the upper portion of a curtain which is separably attached to its holding means.

Each connecting member 22 can constitute or form part of means for holding a portion of a preferably light-transmitting curtain 21 (FIG. 2) which includes vertically extending sections between neighboring slats 14. Such sections of the curtain 21 intercept at least some light when the slats 14 are turned to the end positions which are shown in FIG. 2 (in which the slats intercept no light or a minimum amount of light), and the sections of the curtain form loops which enhance the appearance of the blind 10 as well as of the door or window in or on which the blind is put to use. The left-hand portion of FIG. 2 shows the cross-sectional outline of the curtain 21 at its lower end or intermediate its upper and lower ends. The configuration of the upper end portion of the curtain 21, namely of the portion which is held by the connecting members 22 for the upper end portions of the slats 14, is indicated in the right-hand portion of FIG. 2 by broken lines.

FIG. 2 further shows that the curtain 21 is looped around one vertically extending marginal portion or edge portion of each slat 14 and that the dimensions of curtain sections between neighboring slats 14 are selected with a view to ensure that the curtain cannot interfere with turning of the slats between the illustrated end positions and the other end positions in which the marginal portions of neighboring slats 14 normally overlap. As mentioned above, the curtain 21 can transmit substantial amounts of light. Nevertheless, the curtain provides privacy for the person or persons occupying the room at the inner side of the blind 10 and it also contributes to the appearance of the blind.

The velvety strip 21*a* at the upper end of the curtain 21 can be provided with colored and/or other indicia to facilitate rapport.

It is equally possible to employ an opaque or partially opaque curtain (this term is intended to embrace relatively lightweight curtains as well as heavier curtains normally called drapes), for example, if it is desired to prevent the penetration of light but to enable the slats to turn between their end positions to admit larger or smaller quantities of air by way of the gaps between the slats and through the material of the curtain.

FIGS. 3 and 4 show a first curtain holding device which includes a plate-like connecting member 22 and further includes an inverted U-shaped coupling member or adapter 25. The connecting member 22 is detachably secured to the stub shaft 13 of the respective trolley 12 in a manner as described with reference to FIG. 7, and the coupling member 25 has a web which overlies the horizontal upper marginal portion of the connecting member 22. The coupling member 25 further comprises two parallel vertical walls or legs 26, 27 which flank the connecting member 22. The longer leg 27 has a centrally located open-ended vertical slot 30 which communicates with an opening 29 in the central portion of the web of the coupling member 25. The slot 30 enables the shaft 13 to enter the opening 29 or to leave this opening while the connecting member 22 remains attached to the retaining portion 23 at the lower end 24 of the stub shaft 13. The connection between the member 22 and the shaft 13 is such that the member 22 shares all movements of the shaft about its vertical axis. The connecting member 22 is securely confined between the legs or walls 26, 27 of the coupling member 25 in a region 28 adjacent the upper portion of the slot 30.

The connecting member 22 and/or the coupling member 25 can be made of or can contain a suitable plastic material.

The coupling member 25 is provided with means for securing a portion of the curtain 21 thereto. Such 25 securing means includes strips 31 which are designed to cling to the upper portion 21*a* of the curtain 21. To this end, the strips 31 are provided with barbs of like slender projections of the type used in so-called "VELCRO" (trademark) connectors. The upper portion 21*a* of the curtain 21 is preferably provided with the aforementioned strip of a velvety material (or the upper end portion 21*a* of the curtain 21 can consist of such material) to ensure pronounced adherence to the strips 31 which are provided at the outer sides of the legs 26 and 27 Nevertheless, the upper end portion 21*a* of the curtain 21 can be detached from the strips 31, e.g., for the purpose of cleaning or replacement. The strips 31 can form integral parts of the respective legs 26, 27 of the coupling member 25, especially if the latter is made of a plastic material.

The connecting members 22 can be made of a metallic or plastic material (e.g., polyvinyl chloride). Each connecting member 22 can be rigid or it can be made of a flexible material.

FIGS. 5 and 6 show a modified curtain holding device which does not employ a discrete coupling member. Instead, both sides of the plate-like connecting member 22 are provided with strips or layers 31 which tend to cling to a curtain, particularly to a velvety material of or on the upper portion 21*a* of the curtain. The connecting member 22 is separably secured to the upper end portion of the respective slat 14 (not shown in FIGS. 5 and 6). The connecting member 22 of FIGS. 5 and 6 can be put to use to carry a part of the upper portion of a curtain 21 when the slats 14 are detached, e.g., for the purposes of replacement or cleaning. However, it is equally possible to use the connecting member 22 of FIGS. 5 and 6 as a means for simultaneously holding the upper end portion of a slat and the upper portion of a curtain.

Figure 8:
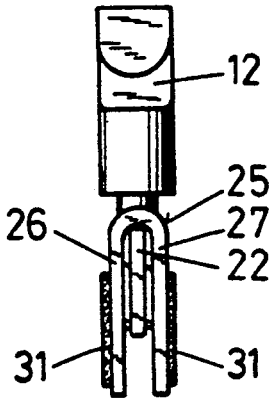
FIG. 8 is an end elevational view of an assembled curtain holding and slat connecting device of the type shown in FIG. 7.

Referring again to FIGS. 7 and 8, the curtain holding device which is shown therein includes a plate-like connecting member 22 which can be held by the hook-shaped retaining portion 23 at the lower end 24 of the stub shaft 13, and an inverted U-shaped coupling member or adapter 25 with two identical legs 26, 27 having outer sides provided with strips 31 which tend to cling to the upper portion 21*a* of a curtain 21. The opening 29 in the web of the coupling member 25 and the adjacent portions of the legs or walls 26, 27 does not communicate with an open-ended slot (such as the slot 30 of FIG. 3). Therefore, the coupling member 25 can be indirectly suspended from the trolley 12 only upon detachment of the connecting member 22 from the shaft 13. Thus, and as shown in FIG. 7, the shaft 13 must be caused to pass through the opening 29 of the coupling member 25 before the retaining portion 23 of the shaft 13 can be engaged by the complementary retaining portion of the plate-like connecting member 22. The fully assembled device 22+25+31+31 for releasably holding a part of the upper portion 21*a* of a curtain 21 is shown in FIG. 8.

The improved blind, and particularly its curtain holding devices, can be modified in a number of additional ways without departing from the spirit of the invention. For example, the strips 31 which tend to cling to the velvety material of a curtain can be replaced with slide fasteners of all kinds (including zippers with or without teeth), snap fasteners, hooks and eyelets and/or others. Moreover, the strips 31 can be permanently bonded (e.g., glued or welded) to the connecting members 22 or to the coupling members 25, or such strips can be secured to the members 22 or 25 by means of stitches, staples or the like. Still further, the blind can be used without slats 14, i.e., the trolleys 12 can merely carry devices for holding the upper portion of a curtain. Reference may be had again to FIGS. 5 and 6 which show a connecting member 22 constituting the only means for holding a part of the upper portion of a curtain on the respective trolley 12. The leg or wall 26 or 27 of the coupling member 25 which is shown in FIGS. 7 and 8 can be provided with a slot (corresponding to the slot 30 which is shown in FIG. 3) in order to ensure that such coupling member can be mounted on a trolley 12 while the slat connecting member 22 remains attached to the shaft 13 of such trolley. The slot is preferably configurated, located and dimensioned in such a way that at least the major part of the respective leg 26 or 27 can attract a portion of a curtain. The blind 10 can be of the type described with reference to FIG. 1, or it may include slats which are maintained at fixed distances from each other, i.e., wherein the cord 19 can be omitted.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the above outlined contribution to the art and, therefore, such adaptations should and are intended to be comprehended within the meaning and range of equivalence of the appended claims.

What is claimed is:

1. A blind comprising an elongated support; a row of carriers provided on said support and arranged to support the upper end portions of discrete substantially vertical slats; and curtain holding means provided on said carriers for supporting a discrete curtain independently of the slats.

2. The blind of claim 1, wherein said support defines an elongated substantially horizontal track and said carriers include trolleys which are movable along said track.

3. The blind of claim 1, wherein said holding means includes means for connecting the upper end portions of slats to the respective carriers.

4. The blind of claim 3, wherein said holding means further comprises means for suspending a curtain on said connecting means.

5. The blind of claim 4, wherein said suspending means includes coupling members and means for securing a portion of a curtain to each of said coupling members.

6. The blind of claim 5, wherein said securing means includes means for clinging to the respective portions of a curtain.

7. The blind of claim 6, wherein said means for clinging includes strips of barbs.

8. The blind of claim 5, wherein each of said connecting means includes a substantially plate-like member and said coupling members are substantially U-shaped and include pairs of legs flanking the respective plate-like members, said carriers having downwardly extending portions attached to the respective plate-like members and each of said coupling members having an opening for said portion of the respective carrier.

9. The blind of claim 3, wherein each of said connecting means includes a substantially plate-like member having a first side and a second side, at least one side of each of said plate-like members being provided with means for clinging to a portion of a curtain.

10. The blind of claim 2 for use with curtains having portions of a velvety material, wherein said connecting means include means for clinging to velvety material.

11. The blind of claim 2 for use with curtains having upper portions provided with strips consisting of or containing a velvety material and having colored indicia, wherein said connecting means include means for clinging to velvety material.

12. The blind of claim 2, wherein said support defines at least one elongated substantially horizontal track and said carriers include trolleys which are movable along said track and are turnable with respect to said support about substantially vertical axes, said holding means including means for connecting the upper end portions of slats to the respective trolleys and further comprising means for moving said trolleys along said track.

13. The blind of claim 12, further comprising means for turning said connecting means with said carriers about the respective substantially vertical axes with reference to said support.

14. The blind of claim 13, wherein said turning means includes a vertical shaft rotatably mounted in each trolley, defining the respective vertical axis and connected with the upper end portion of a slat, and a horizontal shaft having means for simultaneously turning said vertical shafts with reference to the respective trolleys.

15. A blind comprising an elongated support; a row of carriers provided on said support and arranged to support the upper end portions of discrete substantially vertical slats; and curtain holding means provided on said carriers, said holding means including means for connecting the upper end portions of slats to the respective carriers and means for suspending a curtain on said connecting means, said suspending means comprising coupling members and means for securing a portion of a curtain to each of said coupling members, said securing means being integral with the respective coupling members.

16. The blind of claim 15, wherein said coupling members consist at least in part of a plastic material.

17. A blind comprising an elongated support; a row of carriers provided on said support and arranged to support the upper end portions of discrete substantially vertical slats; and curtain holding means provided on said carriers, said holding means including means for connecting the upper end portions of slats to the respective carriers and means for suspending a curtain on said connecting means, said suspending means comprising coupling members and means for securing a portion of a curtain to each of said coupling members, each of said connecting means including a substantially plate-like member and said coupling members being substantially U-shaped and including pairs of legs flanking the respective plate-like members, and carriers having downwardly extending portions attached to the respective plate-like members and each of said coupling members having an opening for said portion of the respective carrier, said coupling members having webs disposed between the respective pairs of legs and overlying the corresponding plate-like members, said openings being provided in the respective webs.

18. The blind of claim 17, wherein one leg of each of said U-shaped coupling members is longer than the other leg, each of said longer legs having an open-ended slot communicating with the respective opening.

* * * * *